US006940228B2

(12) United States Patent
Aoki et al.

(10) Patent No.: US 6,940,228 B2
(45) Date of Patent: Sep. 6, 2005

(54) LONG-LIFE HIGH-PRESSURE DISCHARGE LAMP AND LAMP UNIT USING SAME

(75) Inventors: Yasushi Aoki, Tokyo (JP); Masahiro Katoh, Toyama (JP)

(73) Assignees: NEC Corporation, Tokyo (JP); A.L.M.T. Corporation, Tokyo (JP)

( * ) Notice: Subject to any disclaimer, the term of this patent is extended or adjusted under 35 U.S.C. 154(b) by 132 days.

(21) Appl. No.: 10/458,385

(22) Filed: Jun. 10, 2003

(65) Prior Publication Data

US 2004/0007979 A1 Jan. 15, 2004

(30) Foreign Application Priority Data

Jun. 10, 2002 (JP) ..... 2002-168484
Dec. 13, 2002 (JP) ..... 2002-362505

(51) Int. Cl.[7] ..... H01J 61/06; H01J 61/73

(52) U.S. Cl. ..... 313/633; 313/630; 313/631; 313/491; 313/639

(58) Field of Search ..... 313/628, 634, 313/639, 642, 631, 571, 630–633, 491, 579

(56) References Cited

U.S. PATENT DOCUMENTS 4,158,789 A * 6/1979 Scholz et al. ..... 313/633
5,357,167 A * 10/1994 Mathews et al. ..... 313/632
RE36,316 E * 9/1999 Cunningham ..... 313/113
6,249,086 B1 * 6/2001 Honda et al. ..... 313/631
6,486,602 B1 * 11/2002 Setzer ..... 313/633
6,492,772 B1 * 12/2002 Takeuchi ..... 313/633
6,593,692 B2 * 7/2003 Kitahara et al. ..... 313/571

FOREIGN PATENT DOCUMENTS

JP 2001118538 A * 4/2001 ..... H01J/61/06
JP 3219084 8/2001
JP 2001-312997 11/2001
JP 2001-319617 A 11/2001

* cited by examiner

*Primary Examiner*—Karabi Guharay
*Assistant Examiner*—Sikha Roy
(74) *Attorney, Agent, or Firm*—Choate, Hall & Stewart LLP

(57) ABSTRACT

A high-pressure discharge lamp comprises a lamp tube made of quartz glass and having a central portion formed in a spherical shape, and a pair of opposing tungsten electrodes inserted into the lamp tube. At least one of the tungsten electrodes is made of a tungsten material which contains more than 10 ppm of one of Co and Ni, or 10 ppm of Co and Ni in total, or a tungsten material which contains 20 ppm or more of at least two of Fe, Co and Ni in total, or a tungsten material which contains 20 ppm or more of Fe. Fe, Co and Ni belong to iron-group metals. The inter-electrode distance, i.e., distance between the leading ends of both tungsten electrodes is set to approximately 1–2 mm or less.

22 Claims, 4 Drawing Sheets

LONG-LIFE HIGH-PRESSURE DISCHARGE LAMP AND LAMP UNIT USING SAME

BACKGROUND OF THE INVENTION

1. Field of the Invention

The present invention relates to high-pressure discharge lamps including a metal halide lamp, an ultra high-pressure mercury lamp and the like, and more particularly to a high-pressure discharge lamp which operates in a condition close to a point source.

2. Description of the Related Art

FIG. 1 illustrates prior art direct-current high-pressure discharge lamp 60 which is described below. A pair of opposing tungsten electrodes 62A, 62B are inserted into lamp tube 61 made of quartz glass. In direct-current high-pressure discharge lamp 60 illustrated in FIG. 1, both tungsten electrodes 62A, 62B have different shapes. In consideration of tungsten which becomes worn due to evaporation during a discharge, tungsten electrode 62A, which acts as an anode in the operation of the discharge lamp, is designed to have larger dimensions than tungsten electrode 62B which acts as a cathode. Tungsten electrodes 62A, 62B are made of highly pure tungsten having the purity of 99.99% or higher. Each of plural iron-group metals contained in the tungsten merely has a content of 10 ppm or less, and even a total of their contents amounts to 10 ppm or less.

Molybdenum rods 64A, 64B are connected to tungsten electrodes 62A, 62B, respectively, through molybdenum foils (Mo foils) 63A, 63B for serving as electric lead wires. Such electrode parts are inserted respectively from insert ports 65A, 65B of lamp tube 61 at both ends thereof, and a rear end of each tungsten electrode 62A, 62B, molybdenum foils (Mo foils) 63A, 63B and one end of each molybdenum rod 64A, 64B are embedded in both end portions of lamp tube 61 with quartz glass. In this way, insert ports 65A, 65B are closed to hermetically seal the interior of lamp tube 61. Hermetically sealed lamp tube 61 is filled with mercury, a halogen gas, and an inert gas after it is evacuated to a high vacuum.

High-pressure discharge lamps as described above may be used for lamp light sources for data projectors represented by a liquid crystal projector, and rear projection televisions. Generally, a lamp for such a projector comprises a reflector which has a parabolic surface for collimating light from a light source and impinging the collimated light onto an optical system. In this configuration, when the light source positioned at the focal point of the parabolic surface of the reflector is a point source, a parallel beam is radiated from an opening of the reflector, so that the light can be efficiently directed to an optical system of the projector on which it is subsequently incident. However, since actual light sources are not ideal point sources but have a certain size, light reflected from the reflector has an expanse, resulting in an incident efficiency to the optical system which is lower than that of an ideal point source. With recent proliferation of projectors, the projectors are required to improve the incident efficiency to the optical system. For this purpose, a so-called short arc lamp is desired for a high-pressure discharge lamp for use as a light source which is required to have a short distance between electrodes and a small discharge plasma to substantially provide a point source condition, in order to improve the incident efficiency to the optical system.

Therefore, when the conventional high-pressure discharge lamp illustrated in FIG. 1 is used in a projector, the inter-electrode distance between the leading ends of both tungsten electrodes 62A and 62B is set to be approximately 1 to 2 mm or less to reduce the length of a discharge plasma, and the ends of the electrodes are designed to have a conical shape to reduce the diameter of the discharge plasma, in order to provide the "short arc" lamp.

However, when the conventional high-pressure discharge lamp is operated for a long time, the following problems occur. FIG. 2 illustrates the shape of the anode after the conventional direct-current high-pressure discharge lamp was operated for 2,000 hours. As illustrated, when the conventional direct-current high-pressure discharge lamp is operated for a long time, the conical leading end of tungsten electrode 62A becomes worn so as to be flat, resulting in a significant increase in the inter-electrode distance. Further, an increasingly blunt angle at the leading end of the anode causes the discharge plasma to radially expand, in contrast to the point source, resulting in a lower incident efficiency to the optical system.

As a known document, JP-A-2001-319617 shows an improvement on the purity of tungsten which is a material for electrodes, wherein an Fe content in a tungsten electrode is desirably 3 ppm or less. In other words, JP-A-2001-319617 proposes a reduction of Fe as impurities for the tungsten electrode.

However, even with these proposals, it is difficult to maintain for a long time the "short arc" condition with a short inter-electrode distance and a small discharge plasma, as is similar to the conventional high-pressure discharge lamp described above. The leading ends of the electrodes are worn to cause a change in shape. Consequently, a projector designed for a "short arc" high-pressure discharge lamp suffers from a significantly reduced incident efficiency to an optical system and a problem of a short product life.

SUMMARY OF THE INVENTION

In view of the problems in the prior art as described above, it is an object of the present invention to provide a high-pressure discharge lamp which is capable of maintaining the "short arc" condition for a long time.

The present invention provides a high-pressure discharge lamp which includes a lamp tube made of quartz glass and hermetically sealed, a pair of opposing electrodes inserted into the lamp tube, and at least mercury and a halogen gas filled in the lamp tube. One of the pair of electrodes is made of a tungsten material which contains more than 10 ppm of one of Co and Ni which belong to iron-group materials; or a tungsten material which contains in total 20 ppm or more of at least two of Fe, Co and Ni which belong to iron-group materials; or a tungsten material which contains 20 ppm or more of Fe. Thus, the high-pressure discharge lamp of the present invention exhibits a high efficiency of a "halogen cycle" in which the tungsten in the electrode material, which evaporates during discharge, returns to the electrodes without sticking to the inner wall of the lamp tube and therefore more efficiently deposits on the leading ends of the electrodes, as compared with a conventional high-pressure discharge lamp which employs electrodes made of a tungsten material that contains 10 ppm or less of one of Fe, Ni and Co, or contains 10 ppm or less of Fe, Ni and Co in total. Thus, the present invention can extend the lifetime of the "short arc" high-pressure discharge lamp because the leading ends of the electrodes are apparently less worn to limit the expanse of the inter-electrode distance. Moreover, a lamp unit can be designed such that the light emission center of the high-pressure discharge lamp is positioned at the focal point of a parabolic surface of a reflector, for use as a light source of a liquid crystal projector, by way of example. The resulting product, i.e., lamp unit can provide a high incident efficiency to an optical system.

The high-pressure discharge lamp may be a direct-current high-pressure discharge lamp, wherein the pair of electrodes may include an anode electrode which is larger than the other. Alternatively, the high-pressure discharge lamp may be an alternating-current high-pressure discharge lamp, wherein the opposing electrodes may have the same shape. In the direct-current high-pressure discharge lamp, at least the anode electrode is preferably made of the tungsten material which contains more than 10 ppm of one of Co and Ni, or the tungsten material which contains 20 ppm or more of at least two of Fe, Co and Ni in total, or the tungsten material which contains 20 ppm or more of Fe. Likewise, in the alternating-current high-pressure discharge lamp, both electrodes are preferably made of the tungsten material which contains more than 10 ppm of one of Co and Ni, or the tungsten material which contains 20 ppm or more of at least two of Fe, Co and Ni in total, or the tungsten material which contains 20 ppm or more of Fe.

The high-pressure discharge lamp as described above is effective particularly when it is designed to be a short-arc lamp.

A lamp unit according to the present invention employs the aforementioned high-pressure discharge lamp. This lamp unit has a reflector with a concave curved surface having a reflective film formed thereon. The high-pressure discharge lamp may be disposed such that the light emission center of the high-pressure discharge lamp is positioned at the focal point of the concave curved surface of the reflector.

The above and other objects, features and advantages of the present invention will become apparent from the following description with reference to the accompanying drawings which illustrate examples of the present invention.

BRIEF DESCRIPTION OF THE INVENTION

Figure 6:
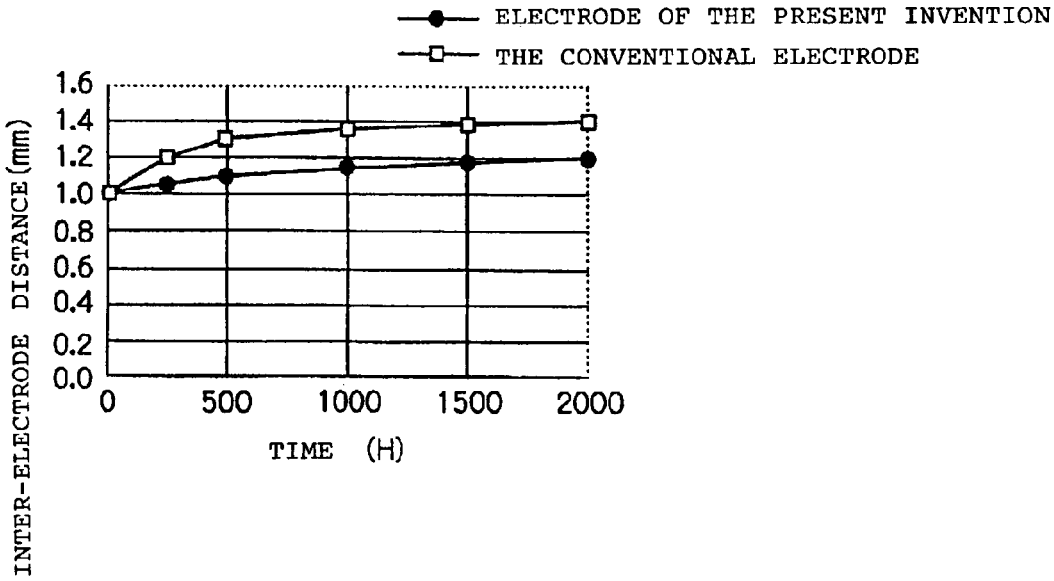
Figure 7:
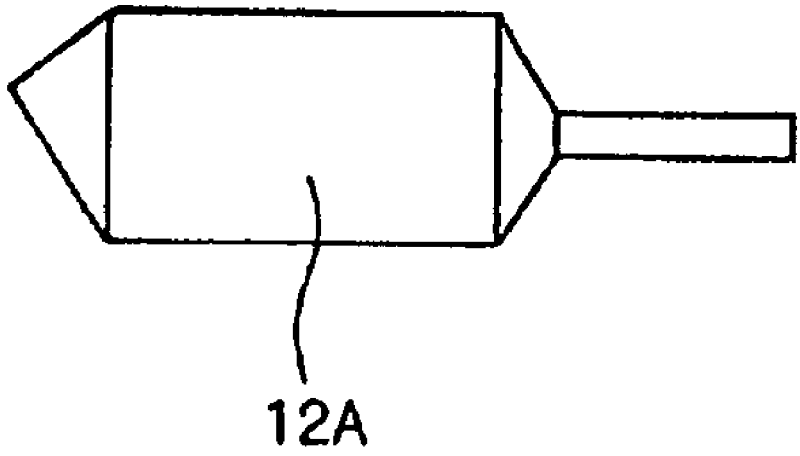

FIG. 6 is a graph showing changes in inter-electrode distance over time of the high-pressure discharge lamp according to the present invention and a conventional high-pressure discharge lamp when a life test is conducted for the two lamps; and FIG. 7 illustrates the shape of an anode of the high-pressure discharge lamp according to the present invention after the lamp has been used for 2,000 hours.

DETAILED DESCRIPTION OF THE PREFERRED EMBODIMENT OF THE INVENTION

Figure 3:
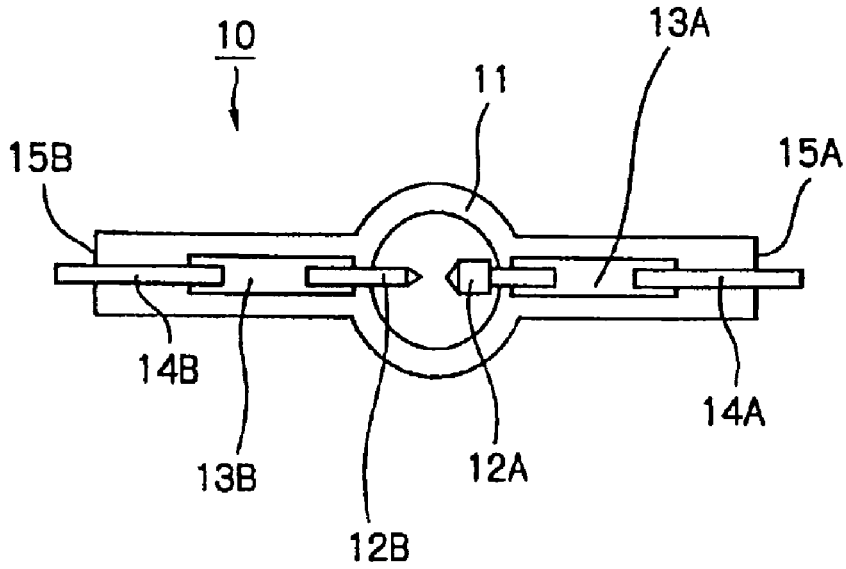
FIG. 3 is a schematic cross-sectional view illustrating a high-pressure discharge lamp according to a first embodiment of the present invention.

Referring to FIG. 3, high-pressure discharge lamp 10 comprises a lamp tube 11 made of quartz glass to have a central portion formed in a spherical shape, and a pair of opposing tungsten electrodes 12A, 12B inserted into lamp tube 11.

Molybdenum rods 14A, 14B are connected to tungsten electrodes 12A, 12B, respectively, through molybdenum foils (Mo foils) 13A, 13B for serving as electric lead wires. Such electrode parts are inserted respectively from insert ports 15A, 15B of lamp tube 11 at both ends thereof, and a rear end of each tungsten electrode 12A, 12B, molybdenum foils (Mo foils) 13A, 13B and one end of each molybdenum rod 14A, 14B are embedded in both end portions of lamp tube 11 with quartz glass. In this way, insert ports 15A, 15B are closed to hermetically seal the interior of lamp tube 11. Hermetically sealed lamp tube 11 is filled with mercury, a halogen gas, and an inert gas after it is evacuated to a high vacuum.

Tungsten electrode 12A or tungsten electrode 12B is made of a tungsten material which contains more than 10 ppm of Ni, which is an iron group metal. High-pressure discharge lamp 10 illustrated in FIG. 3 is a direct-current high-pressure discharge lamp, wherein tungsten electrodes 12A, 12B have different dimensions and shapes. Specifically, the anode electrode is larger. In high-pressure discharge lamp 10 illustrated in FIG. 3, tungsten electrode 12A serves as an anode, while tungsten electrode 12B serves as a cathode, and both are powered from an external power supply. Also, for providing a "short arc" high-pressure discharge lamp, the inter-electrode distance between the leading ends of both tungsten electrodes 12A and 12B is set to be approximately 1 to 2 mm or less to reduce the length of a discharge plasma, and tungsten electrodes 12A, 12B are designed to have a conical end shape to reduce the diameter of the discharge plasma. An exemplary inter-electrode distance may be 1 mm for a 200 W lamp, 1.3 mm for a 250 W lamp, and the like.

In high-pressure discharge lamp 10, a high voltage of approximately 20 kV is applied between tungsten electrodes 12A, 12B for producing an electrical breakdown therebetween. Consequently, a glow discharge is induced in an inert gas atmosphere to evaporate the enclosed mercury, causing an instantaneous transition to an arc discharge. A plasma discharge by a mercury gas radiates light which exhibits a high luminance and good color rendering properties. Also, the halogen gas filled in lamp tube 11 is ionized under high temperature to produce halogen ions while high-pressure discharge lamp 10 is lit, and the halogen ions connect with tungsten (electrode material) which evaporates during the discharge and sticks to the inner wall of the glass tube 11, evaporate, and deposit on the bases of electrodes 12A, 12B which are at relatively low temperatures. By thus repeating a so-called "halogen cycle," the inner wall of glass tube 11 can be prevented from blackening.

It has been found that high-pressure discharge lamp 10 having the electrodes made of the tungsten material which contains more than 10 ppm of Ni exhibits a high efficiency of the "halogen cycle" in which the tungsten or electrode material, which evaporates during discharge, returns to the electrodes without sticking to the wall of the lamp tube and therefore more efficiently deposits on the leading ends of the electrodes, as compared with a conventional high-pressure discharge lamp which employs electrodes made of a tungsten material which contains 10 ppm or less of one of Fe, Ni, Co, or contains 10 ppm or less of Fe, Ni, Co in total. Thus, the present invention can extend the lifetime of the "short arc" high-pressure discharge lamp because the leading ends of the electrodes are apparently worn less to limit the expanse of the inter-electrode distance.

Next, a method of using the foregoing high-pressure discharge lamp 10 will be described with reference to FIG.

4. High-pressure discharge lamp 10 is securely mounted in bowl-shaped reflector 21 with cement 28. Front glass 23 is fixedly fitted in the open end of reflector 21 for purposes of protection in case high-pressure discharge lamp 10 is broken, thereby making up complete lamp unit 20. Generally, reflector 21 is made of glass having a mechanical strength and heat resistance, such as crystallized glass, hard glass or the like, and optical reflective film 22 is vapor-deposited on the inside concave curved surface. This concave curved surface, which may be a parabolic surface, an oval surface or the like, is disposed such that the light emission center of high-pressure discharge lamp 10 is positioned at geometrical focal point 24 of such a curved surface, and fixed with cement 28. It should be noted that while the concave curved surface of reflector 21 may be the foregoing parabolic surface, oval surface or the like, the concave curved surface is not limited to them as long as it has a focal point.

Figure 4:
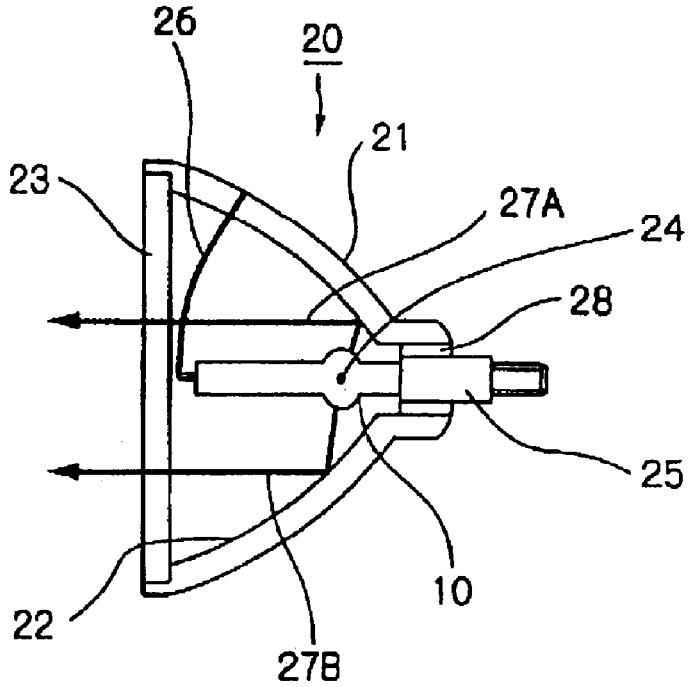
FIG. 4 is a schematic cross-sectional view of a lamp unit which employs the high-pressure discharge lamp illustrated in FIG. 3.

High-pressure discharge lamp 10 is powered through mountpiece 25 and lead wire 26 to produce a discharge in lamp-tube 11. In the example of FIG. 4, reflector 21 having a parabolic surface represents a point source which is the ideal light emitting condition. Light radiated from high-pressure discharge lamp 10 is reflected by reflective film 22 of reflector 21 to be a collimated light beam as represented by arrowed beam trajectories 27A, 27B, which is radiated after it transmits front glass 23 on the open side of reflector 21. This lamp unit 20 is used as a light source for a data projector represented by a liquid crystal projector, and a rear projection television. In this event, when a light source placed at focal point 24 of the parabolic surface is a point source, a collimated light beam is radiated from the opening of reflector 21, so that the light can be efficiently directed to an optical system of the projector on which it is subsequently incident. However, since the actual light source is not the ideal point source but has a certain size, light reflected from reflector 21 has an expanse, resulting in an incident efficiency to the optical system which is lower than that of the ideal point source. With recent proliferation of projectors, the projectors are required to improve the incident efficiency to the optical system. To meet this requirement, a so-called "short arc" lamp is needed for a high-pressure discharge lamp for use as a light source which is required to have a short distance between electrodes and a small discharge plasma to substantially provide a point source condition, in order to improve the incident efficiency to the optical system.

With the use of tungsten electrodes 12A, 12B according to this embodiment, which is made of a tungsten material that contains more than 10 ppm of Ni, the resulting high-pressure discharge lamp is characterized by reduced wear of the leading ends of the electrodes to limit the expanse of the inter-electrode distance. It is therefore possible to realize a high-pressure discharge lamp which has a lifetime of 2,000 hours that is required for a short-arc lamp.

In this embodiment, one of the pair of tungsten electrodes 12A, 12B is made of the tungsten material which contains more than 10 ppm of Ni. Particularly, in a direct-current high-pressure discharge lamp as shown in this example, the anode has become worn more at the leading end due to a long-time operation, so that tungsten electrode 12A, which serves as the anode, is preferably made of the tungsten material which contains more than 10 ppm of Ni. Of course, both tungsten electrodes 12A, 12B are preferably made of the tungsten material which contains more than 10 ppm of Ni from a view point of a long life "short arc."

Figure 5:
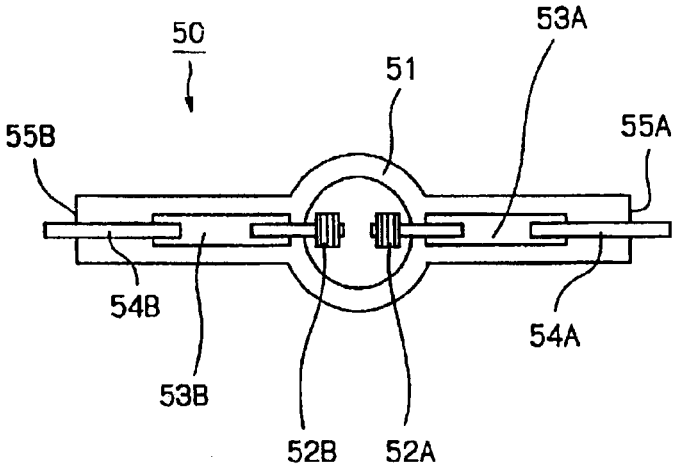
FIG. 5 is a schematic cross-sectional view illustrating a high-pressure discharge lamp according to a second embodiment of the present invention.

Next, another embodiment will be described. FIG. 5 illustrates a schematic cross-sectional view of a high-pressure discharge lamp according to another embodiment. High-pressure discharge lamp 50 illustrated in FIG. 5 is an alternating-current high-pressure discharge lamp which has a pair of opposing tungsten electrodes 52A, 52B inserted into lamp tube 51 made of quartz glass.

Molybdenum rods 54A, 54B for serving as electric lead wires are connected to tungsten electrodes 52A, 52B, respectively, through molybdenum foils (Mo foils) 53A, 53B. Such electrode parts are inserted respectively from insert ports 55A, 55B of lamp tube 51 at both ends thereof, and a rear end of each tungsten electrode 52A, 52B, molybdenum foils (Mo foils) 53A, 53B and one end of each molybdenum rod 54A, 54B are embedded in both end portions of lamp tube 51 with quartz glass. In this way, insert ports 55A, 55B are closed to hermetically seal the interior of lamp tube 51. Hermetically sealed lamp tube 51 is filled with mercury, a halogen gas, and an inert gas after it is evacuated to a high vacuum.

In the alternating-current high-pressure discharge lamp of this embodiment, tungsten electrodes 52A, 52B have the same shape. Tungsten electrodes 52A, 52B are made of a tungsten material which contains 20 ppm or more of Ni and Fe in total. Also, for providing a "short arc" high-pressure discharge lamp, the inter-electrode distance between the leading ends of both tungsten electrodes 52A, 52B is set to be approximately 1 to 2 mm or less, and tungsten electrodes 52A, 52B are designed to have a protruding end shape.

As a high voltage of approximately 20 kV is applied between tungsten electrodes 52A and 52B for producing an electrical breakdown therebetween, a glow discharge is induced between both electrodes in an inert gas atmosphere to evaporate the enclosed mercury, causing an instantaneous transition to an arc discharge. After the transition to the arc discharge, tungsten electrodes 52A, 52B are applied with an alternating-current voltage at a frequency in a range of several tens to several hundreds Hz, which is the operating frequency in a steady state, after the discharge is stabilized, leading to a steady alternating-current arc discharge. Likewise, in a long-time operation, this alternating-current high-pressure discharge lamp produces the effect of limiting the expanse of the inter-electrode distance associated with the evaporation of the leading ends of the electrodes to maintain the protrusions at the leading ends.

In addition, the alternating-current high-pressure discharge lamp according to this embodiment is also useful as the light source for the projector lamp unit illustrated in FIG. 4.

EXAMPLES

FIG. 6 shows changes in the inter-electrode distance over time, measured by the radiography in a life test conducted for the direct-current high-pressure discharge lamp according to the present invention which has the anode made of a tungsten material that contains more than 10 ppm of Ni, and a conventional direct-current high-pressure discharge lamp which has an anode made of a tungsten material that contains 10 ppm or less of Ni. As can be seen from the graph, when the initial inter-electrode distance is 1 mm, the inter-electrode distance extends to approximately 1.4 mm in the conventional direct-current high-pressure discharge lamp after 2,000 hours, whereas the inter-electrode distance extends merely to approximately 1.2 mm in the direct-current high-pressure discharge lamp according to the present invention.

Figure 1:
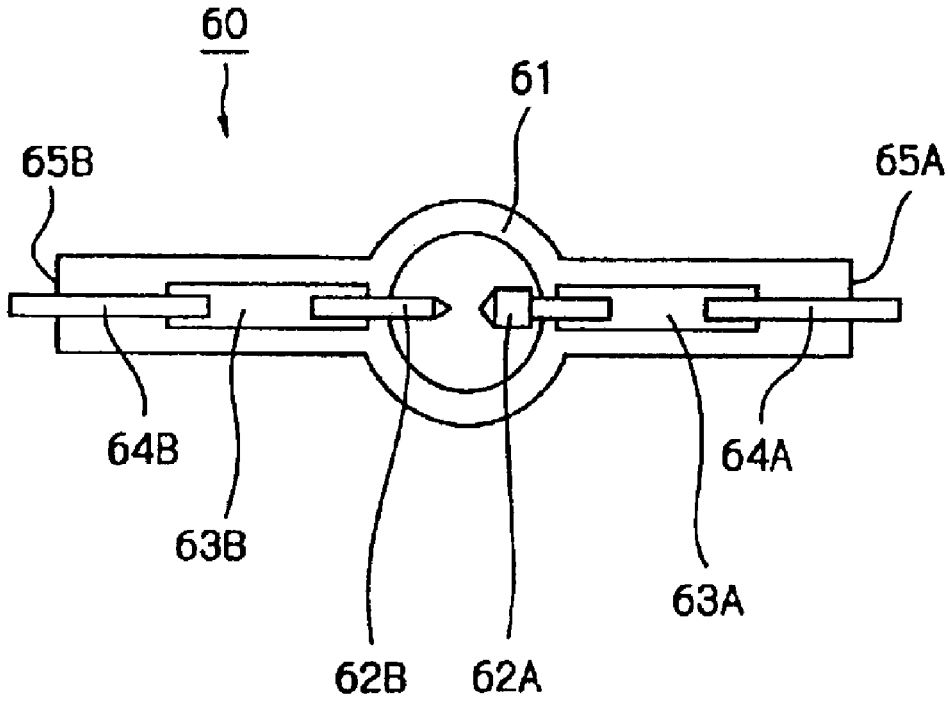
Fig. 1 (Prior Art)
FIG. 1 is a schematic cross-sectional view illustrating a conventional direct-current high-pressure discharge lamp.
Figure 2:
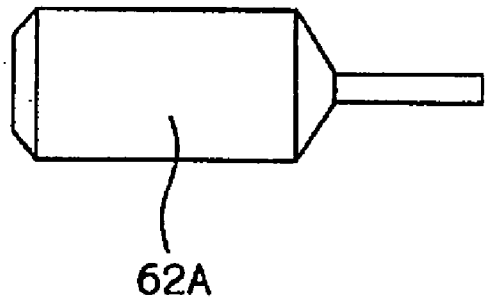
Fig. 2 (Prior Art)
FIG. 2 illustrates the shape of an anode of the conventional high-pressure discharge lamp after the lamp has been used for 2,000 hours.

FIG. 7 illustrates the shape of the anode in the direct-current high-pressure discharge lamp according to the present invention after the lamp has been used for 2,000 hours. When the conventional direct-current high-pressure discharge lamp is operated for a long time, the anode has become worn at the conical leading end, so that a resulting flat surface of the anode points to the opposing electrode (see FIG. 2). On the other hand, the anode of the direct-current high-pressure discharge lamp according to the present invention is deformed from the initial shape which has a bi-symmetric cross-sectional view about the center axis to a shape having an offset axis, as illustrated in FIG. 7, however, the conical protrusion remains at the leading end of the electrode. This demonstrates that although the electrode has become, the tungsten again deposits on the electrode through the halogen cycle to produce an effect of apparently reducing the expanse of the inter-electrode distance.

Also, the life test was conducted for the tungsten electrodes made of materials containing each of Fe, Ni, Co, and each of combinations of Fe and Ni, Ni and Co, and Fe and Co, all belonging to iron-group metals, each of which serves as the anode of the direct-current high-pressure discharge lamp, for comparing the lengths by which the electrodes were worn after 2,000 hours of operation. Table 1 shows the result of this test.

TABLE 1

| MATELIAL(S) CONTAINED IN TUNGSTEN ELECTRODE | CONTENT | LENGTH OF ABRADED ELECTRODE (AFTER 2,000 HOURS) | DETER-MINA-TION |
|---|---|---|---|
| | Fe, Co, Ni < 10 ppm | 0.41 mm | X |
| Fe | 17 ppm | 0.35 mm | X |
| Fe | 21 ppm | 0.20 mm | ○ |
| Fe | 1000 ppm | 0.19 mm | ○ |
| Ni | 12 ppm | 0.22 mm | ○ |
| Co | 10 ppm | 0.21 mm | ○ |
| Fe + Ni | 20 + 10 ppm | 0.22 mm | ○ |
| Ni + Co | 10 + 10 ppm | 0.20 mm | ○ |
| Fe + Co | 20 + 20 ppm | 0.19 mm | ○ |

"Fe, Co, Ni<10 ppm" in the table indicates that the content of any of Fe, Ni, Co or their total content is equal to or less than 10 ppm.

As can be seen from this table, it can be confirmed that Co alone and combinations of the foregoing iron-group metals are also effective in maintaining the shape of the electrode.

Therefore, in the direct-current high-pressure discharge lamp in the configuration illustrated in FIG. 3, one of the pair of tungsten electrodes 12A, 12B is made of a tungsten material which contains more than 10 ppm of Ni, however, tungsten electrode 12A or 12B which contains more than 10 ppm of Co, instead of Ni, likewise exhibits a shorter abraded length at the leading end thereof, as demonstrated in Table 1. In addition, when tungsten electrode 12A or 12B contains only Fe, the content of Fe equal to 20 ppm or more is effective in maintaining the shape of the electrode. Furthermore, not limited to the tungsten material which contains one of Co and Ni, belonging to iron-group metals, with a content of 10 ppm or more, the effect of maintaining the shape of electrode can be produced as well when tungsten electrode 12A or 12B is made of a tungsten material which contains 20 ppm or more of at least two of Fe, Co and Ni which belong to iron-group materials.

In the alternating-current high-pressure discharge lamp in the configuration illustrated in FIG. 5, tungsten electrode 52A, 52B are made of a tungsten material which contains 20 ppm or more of Ni and Fe in total. Not limited to this material, however, it has been confirmed that tungsten electrodes 52A, 52B suffer from a less amount of wear at the leading ends thereof when the cathode and anode are made of a tungsten material which contains 10 ppm or more of one of Co and Ni which belong to iron-group metals; a tungsten material which contains 20 ppm or more of Fe; or a tungsten material which contains 20 ppm or more of at least two of Fe, Co and Ni.

The material for the electrodes for use in the high-pressure discharge lamp of the present invention is preferably a tungsten material which contains 10 ppm or more of one of Co and Ni which belong to iron-group metals; or a tungsten material which contains 20 ppm or more of at least two of Fe, Co and Ni. However, since excessive impurities contained in the tungsten electrode would cause a problematic reduction in mechanical strength, particularly, anti-shock property, the content of these iron-group metals is preferably limited to 1% (10,000 ppm) at most.

While the foregoing embodiments illustrated in FIGS. 3 and 5 are generally called "ultra-high pressure mercury lamps," the high-pressure discharge lamp according to the present invention is not limited to this particular type of lamp, but may be applied, for example, to a metal halide lamp.

As described above, the electrode of the high-pressure discharge lamp according to the present invention is made of a tungsten material which contains more than 10 ppm of one of Co, Ni, which belong to iron-group materials; or a tungsten material which contains 20 ppm or more of at least two of Fe, Co and Ni in total; or a tungsten material which contains 20 ppm or more of Fe. Since the resulting electrode has become less worn at the leading end thereof to reduce the expanse of the inter-electrode distance than the conventional high-pressure discharge lamp which has electrodes made of a tungsten material that contains 10 ppm or less of one of Fe, Co and Ni or 10 ppm or less of these elements in total, the present invention can extend the lifetime of the "short-arc" high-pressure discharge lamp. Further, a lamp unit can be designed such that the light emission center of the high-pressure discharge lamp is positioned at the focal point of a parabolic surface of the reflector, for use as a light source of a liquid crystal projector, by way of example. The resulting product, i.e., lamp unit can provide a high incident efficiency to an optical system.

While preferred embodiments of the present invention have been described using specific terms, such description is for illustrative purposes only, and it is to be understood that changes and variations may be made without departing from the spirit or scope of the following claims.

What is claimed is:

1. A high-pressure discharge lamp comprising:

a hermetically sealed lamp tube made of quartz glass;

a pair of opposing electrodes inserted into said lamp tube; and at least mercury and a halogen gas filled in said lamp tube;

wherein one of said pair of electrodes is made of a tungsten material which contains more than 10 ppm of one of Co and Ni which belong to iron-group materials.

2. The high-pressure discharge lamp according to claim 1, wherein said high-pressure discharge lamp is a direct-current high-pressure discharge lamp, wherein said electrode made of the tungsten material which contains more than 10 ppm of one of Co and Ni is an anode.

3. The high-pressure discharge lamp according to claim 2, wherein said pair of electrodes include an anode electrode which is larger than the other.

4. The high-pressure discharge lamp according to claim 1, wherein said high-pressure discharge lamp is an alternating-current high-pressure discharge lamp, wherein the other electrode is also made of the tungsten material which contains more than 10 ppm of one of Co and Ni.

5. The high-pressure discharge lamp according to claim 4, wherein said pair of electrodes have the same shape.

6. The high-pressure discharge lamp according to claim 1, wherein said high-pressure discharge lamp is designed to be a short-arc lamp.

7. A lamp unit using said high-pressure discharge lamp according to claim 1, comprising:

a reflector having a concave curved surface formed with a reflective film thereon, said high-pressure discharge lamp being disposed such that a light emission center thereof is positioned at a focal point of the concave curved surface of said reflector.

8. A high-pressure discharge lamp comprising:

a hermetically sealed lamp tube made of quartz glass;

a pair of opposing electrodes inserted into said lamp tube; and at least mercury and a halogen gas filled in said lamp tube;

wherein one of said pair of electrodes is made of a tungsten material which contains in total 20 ppm or more of at least two of Fe, Co and Ni which belong to iron-group materials.

9. The high-pressure discharge lamp according to claim 8, wherein said high-pressure discharge lamp is a direct-current high-pressure discharge lamp, wherein said electrode made of the tungsten material which contains in total 20 ppm or more of at least two of Fe, Co and Ni is an anode.

10. The high-pressure discharge lamp according to claim 9, wherein said pair of electrodes include an anode electrode which is larger than the other.

11. The high-pressure discharge lamp according to claim 8, wherein said high-pressure discharge lamp is an alternating-current high-pressure discharge lamp, wherein the other electrode is also made of the tungsten material which contains in total 20 ppm or more of at least two of Fe, Co and Ni which belong to iron-group materials.

12. The high-pressure discharge lamp according to claim 11, wherein said pair of electrodes have the same shape.

13. The high-pressure discharge lamp according to claim 8, wherein said high-pressure discharge lamp is designed to be a short-arc lamp.

14. A lamp unit using said high-pressure discharge lamp according to claim 8, comprising:

a reflector having a concave curved surface formed with a reflective film thereon, said high-pressure discharge lamp being disposed such that a light emission center thereof is positioned at a focal point of the concave curved surface of said reflector.

15. A high-pressure discharge lamp comprising:

a hermetically sealed lamp tube;

a pair of opposing electrodes inserted into said lamp tube; and at least mercury and a halogen gas filled in said lamp tube;

wherein at least one of said pair of electrodes is made of a tungsten material which contains more than 20 ppm of Fe.

16. The high-pressure discharge lamp according to claim 15, wherein said high-pressure discharge lamp is a direct-current high-pressure discharge lamp, wherein said electrode made of the tungsten material which contains more than 20 ppm of Fe is an anode.

17. The high-pressure discharge lamp according to claim 16, wherein said pair of electrodes include an anode electrode which is larger than the other.

18. The high-pressure discharge lamp according to claim 15, wherein said high-pressure discharge lamp is an alternating-current high-pressure discharge lamp, wherein the other electrode is also made of the tungsten material which contains more than 20 ppm of Fe.

19. The high-pressure discharge lamp according to claim 18, wherein said pair of electrodes have the same shape.

20. The high-pressure discharge lamp according to claim 15, wherein said high-pressure discharge lamp is designed to be a short-arc lamp.

21. A lamp unit using said high-pressure discharge lamp according to claim 15, comprising:

a reflector having a concave curved surface formed with a reflective film thereon, said high-pressure discharge lamp being disposed such that a light emission center thereof is positioned at a focal point of the concave curved surface of said reflector.

22. A high-pressure discharge lamp, comprising:

a hermetically sealed lamp tube;

a pair of opposing electrodes disposed in said lamp tube; and at least mercury and a halogen gas enclosed in said lamp tube;

wherein at least one of said pair of electrodes is made of a tungsten material which contains more than 10 ppm of at least one of Co and Ni.

* * * * *